United States Patent [19]

Chenard

[11] Patent Number: 5,027,719

[45] Date of Patent: Jul. 2, 1991

[54] ROTARY GRATE FOR A SOLID FUEL FURNACE

[75] Inventor: Mark R. Chenard, West Boylston, Mass.

[73] Assignee: Wellons, Inc., Sherwood, Oreg.

[21] Appl. No.: 486,239

[22] Filed: Feb. 28, 1990

[51] Int. Cl.[5] ..... F23J 1/00; F23J 1/06; F23H 9/02; F23K 3/00

[52] U.S. Cl. ..... 110/165 R; 110/171; 110/267; 110/268; 110/275; 110/276; 110/286; 110/327; 110/328

[58] Field of Search ..... 110/165, 235, 266, 267, 110/268, 275, 276, 278, 281, 286, 287, 298, 327, 328, 165 R, 171

[56] References Cited

U.S. PATENT DOCUMENTS

| | | | |
|---|---|---|---|
| 1,797,721 | 3/1931 | Erlich | 110/276 |
| 1,806,178 | 5/1931 | Rathgeb, Jr. | 110/328 X |
| 1,961,098 | 5/1934 | Denker | 110/276 |
| 2,322,283 | 6/1943 | Denny | 110/276 |
| 2,355,101 | 8/1944 | Norman | 110/276 |
| 4,073,244 | 2/1978 | Snowdon | 110/165 R X |
| 4,459,921 | 7/1984 | Unger | 110/276 X |
| 4,699,070 | 10/1987 | O'Conner | 432/117 X |
| 4,787,321 | 11/1988 | Schnellbacher et al. | 110/268 X |

*Primary Examiner*—Henry A. Bennett
*Assistant Examiner*—Christopher B. Kilner
*Attorney, Agent, or Firm*—Klarquist, Sparkman, Campbell, Leigh & Whinston

[57] ABSTRACT

The present invention discloses a rotary grate for a solid fuel fired furnace which allows ash, cinders and clinkers to be removed from the burning fuel mass, without reducing or stopping the combustion process. A plurality of parallel water cooled rolls supports the burning fuel mass. The rolls are grouped into pairs of rolls, each pair of rolls having a drive roll and a driven roll. Each pair of rolls are geared together such that rotation of the drive roll simultaneously rotates the driven roll. Each roll has a plurality of protrusions about the circumference thereof, spaced down the length of the roll. The protrusions pass, during rotation of the rolls, the protrusions on adjacent rolls in non-contacting relationship to crush any cinders, clinkers or other tramp material. This action allows ash and the crushed material to pass between the rolls to an ash collection area beneath the rolls. Each of the drive rolls are rotated by a reversible drive mechanism which incrementally rotates the rolls.

13 Claims, 7 Drawing Sheets

ROTARY GRATE FOR A SOLID FUEL FURNACE

TECHNICAL FIELD

This invention relates to a solid fuel fired furnace and, in particular, to a rotary grate for a solid fuel fired furnace which allows continuous removal of ash and other solid products of combustion during firing of the furnace.

BACKGROUND OF THE INVENTION

In solid fuel fired furnaces, the fuel must be supported by a grate. The grate forms a means to support the burning fuel mass and to allow combustion air to be drawn up through the grate, to the burning mass, to aid combustion.

Several grates have been devised to perform this function. The simplest is a fixed grate which may be air or water cooled. Fixed grates, however, require that the firing rate of the solid mass be reduced or stopped to allow manual raking of the ash through the grates. Of course, while doing this, the boiler or heating system suffers, adversely affecting process and requiring much lost time in regaining operating temperatures once ash was removed. This also exposes the individual doing the raking to high temperature extremes from 20 minutes to an hour. Shutting down the system also allows cold air to contact refractory, creating a cold shocking condition which can cause spalling and checking of refractory which shortens operating life.

Traveling grates have been designed which move slowly across the furnace area picking up new fuel on one side and depositing the ash and other solid products of combustion on the far side of the furnace for removal. These grates are typically complicated, expensive and bulky. Traveling grates are also difficult to water cool.

Incline grates have also been used where the fuel enters the upper end, ignites, and burns while slowly sliding either by gravity or a mechanical means to an ash pit at the lower end.

Step grates combine several of the features of incline grates, wherein the burning fuel is jogged from one step to a lower step and eventually to an ash pit.

Still other grates have been devised which have hinged or pivoted portions which rotate or drop, thereby dropping the loose ash into a pit below the grate.

Another type of grate has built-in nozzles that are sequentially operated using air or steam to blast and direct the ash toward a lower ash pit for removal.

Many of the foregoing described grate systems have had limited success and are designed for very narrow usages. The grate design must take into account the way fuel is presented to the firing arrangement, how the firing affects the furnace, how the furnace configuration can rid itself of ash with interrupted or continuous firing and the type of solid fuel being fired and the amount of ash produced.

A need, therefore, exists for a grate for a solid fuel fired furnace which will support the burning fuel mass, allow air to circulate up through the burning fuel mass to support combustion, allow ash to fall through the grate to a collection area and crush or reduces the size of cinders, slag or clinkers which form beneath or within the burning fuel mass.

SUMMARY OF THE INVENTION

The present invention discloses a solid fuel fired furnace and a grate to be used in conjunction with the furnace, which allows firing to be continued without disturbance while ash is removed either continually or at timed intervals depending upon volume. This is accomplished by pile burning on a group of parallel tubular rolls which index in a ratching manner creating a grinding effect on the ash. The tubular rolls have knobs firmly attached to their periphery, which are not unlike stubbed gear teeth. The rolls are assembled in pairs, tied together to rotate in opposite directions by special high strength spur gears attached to the shafts.

The rolls are spaced apart, parallel to one another, allowing for the knob surfaces to pass by each other and also providing space for passage of first-stage combustion air. The ash produced by burning the solid fuel may be powdery, granular, or molten, in which case, clinkers can form when chilled by the grate surface. A protective layer of ash is formed over the counter rotating tubular rolls. However, when depth is excessive enough to adversely influence combustion air, each pair of rolls rotate, crushing the ash between them and dropping the ash to an ash pit below the rolls for removal. This rotation can be done intermittently or continuously depending upon time taken for ash formation.

These crushing tubular rolls are hydraulically powered by a special indexing, ratcheting mechanism which has built-in load limits to prevent overload and self-destruction. Should an overload condition occur (usually created by foreign tramp material, such as rock), the pair of tubes suffering the overload may be reversed, until such tramp material is ground fine enough to pass through the roll openings or, if this is not possible, manually removed through access ports provided.

The tubular crushing rolls are water cooled. The water is fed through a high temperature rotary union to a water supply tube or lance. The water supply tube runs the length of the inside of the tubular roll on the roll center line. The water is released at the far end of the water supply tube, allowing the water to return between the outside of the water supply tube and the inside of the tubular roll, contacting the internal surface of the tubular roll, insuring protection from over temperature. The water then flows through the exhaust side of the rotary union, where it is collected.

It is an object of the invention to provide a grate for a solid fuel fired furnace which allows ash removal without interrupting the continuous burning of the solid fuel pile.

It is another object of the invention to provide a grate for a solid fuel fired furnace which allows combustion air to pass through the grate and the burning fuel pile.

It is also an object of the invention to provide a grate for a solid fuel fired furnace which can reduce the size of cinders, slag or clinkers to allow them to pass through the grate into an ash collection pit.

Other objects and advantages of the present invention will be apparent from the following description of a preferred embodiment thereof and from the attached drawings.

DETAILED DESCRIPTION OF THE INVENTION

Figure 1:
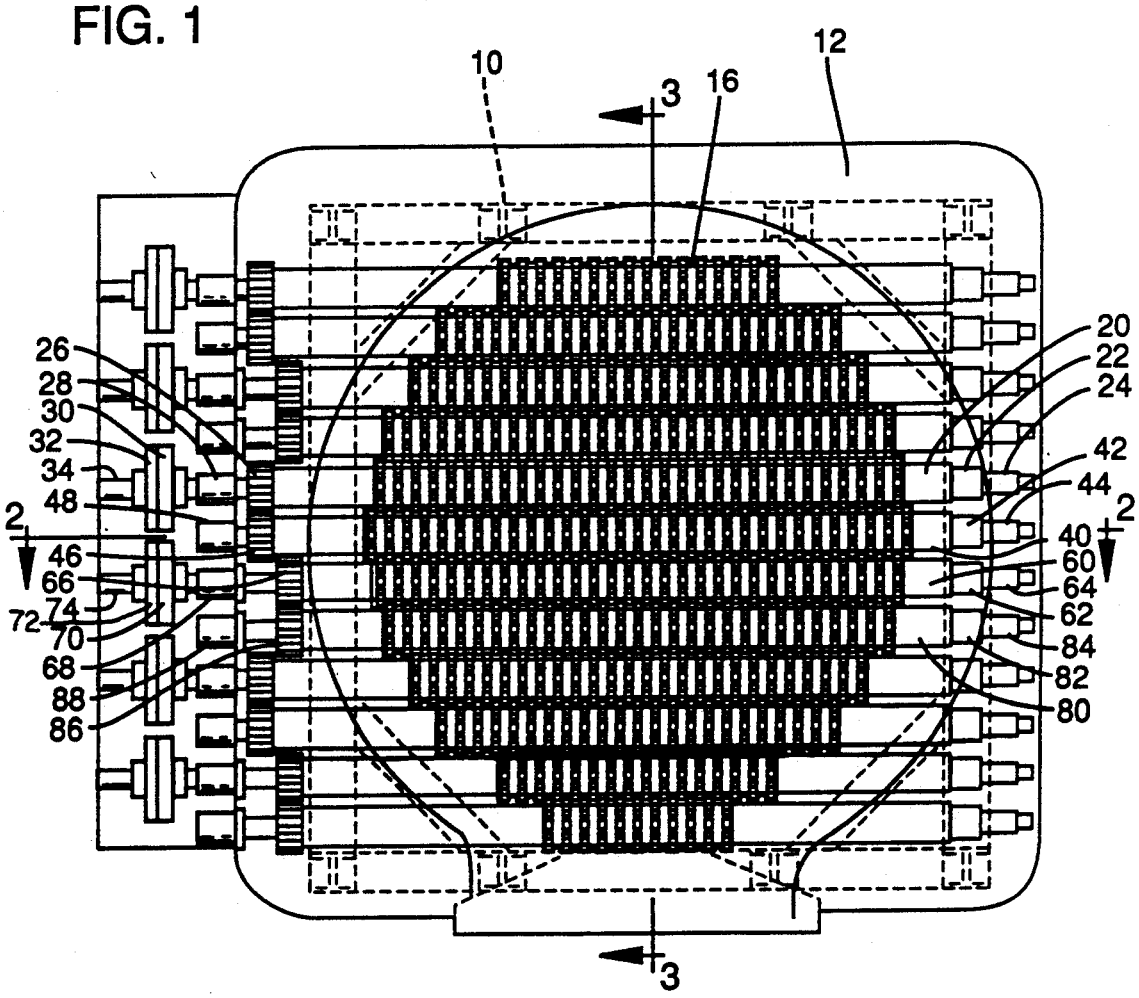
FIG. 1 is a top view of the grate portion of a solid fuel fired furnace.

Referring now to FIG. 1, a rotary grate assembly is supported by a framework 10 comprised of steel structural members. Overlaying the framework 10, is a refractory layer 12. The refractory 12 has an opening 16 through which a plurality of tubular rolls protrude.

The tubular rolls are organized in pairs, such as drive roll 20 and driven roll 40. The drive roll 20 is supported by the framework 10 on its first end by a bearing 22. Coupled to the roll 20 outboard of the bearing 22 is a rotatable union 24. The union will be explained below. On a second end of the drive roll 20 is a spur gear 26. The second end of the drive roll is supported in the framework 10 by another bearing 28 outboard of gear 26. A drive disk 30 is suitably attached to the second end of the drive roll 20. Cooperating with the drive disk 30 is a ratchet plate 32. Outboard of plate 32 is an additional or third bearing 34 which further supports the roll 20.

A driven roll 40, in conjunction with the drive roll 20, forms a first pair of rotatable rolls. The first end of roll 40 is supported on the framework 10 by a bearing 42. A rotatable union 44 is coupled outboard of bearing 42 to roll 40. The second end of the driven roll 40 has a spur gear 46 attached thereon. Spur gear 46 is in tooth-to-tooth engagement with the spur gear 26 of drive roll 20. The second end of driven roll 40 is supported in framework 10 by a bearing 48. A second pair of rolls, consisting of a drive roll 60 and a driven roll 80, are parallel to and in the same plane as the above-described drive roll 20 and driven roll 40. Drive roll 60 again is supported on the first end by a bearing 62 and has a rotatable water union 64 attached outboard thereof. The second end has a spur gear 66 mounted thereon and is supported in the framework 10 by a bearing 68. A drive disk 70 is suitably attached to the drive roll 60. A ratchet plate 72 is rotatable on the drive roll. A third bearing 74 supports the outermost portion of the second end of the drive roll 60 in framework 10. The driven roll 80 is supported on the first end by a bearing 82 and has a rotatable water union 84 on the first end thereof. A spur gear 86 is mounted on the second end thereof and is again supported by a bearing 88 on the frame 10. Spur gear 86 is in engagement with spur gear 66. Spur gears 66 and 86 are in a plane offset from the plane of spur gears 26 and 46 to prevent any interference between the pairs of spur gears.

Figure 2:
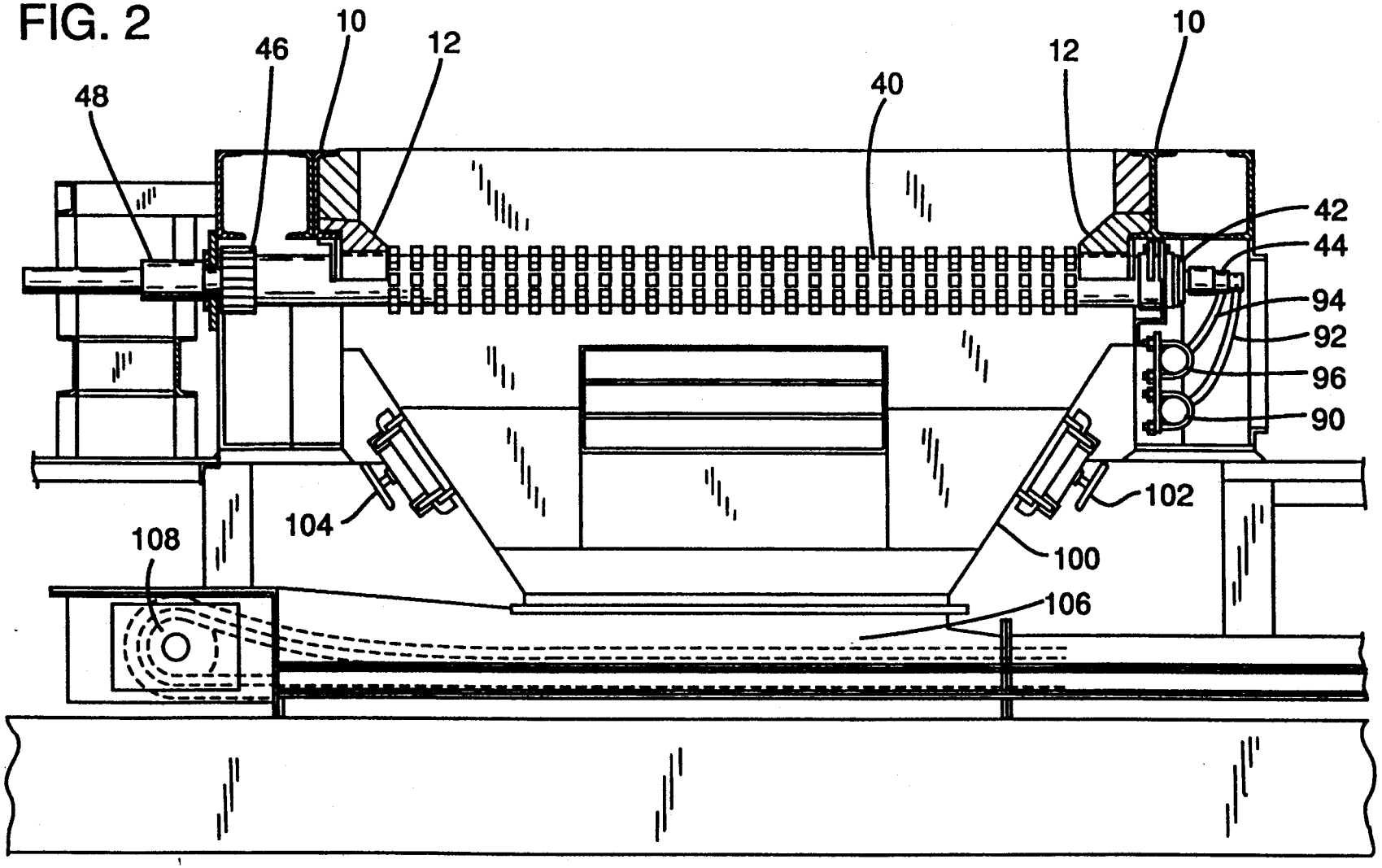
FIG. 2 is a cross-sectional view, along lines 2—2 of FIG. 1, of the grate portion of a fuel fired furnace, additionally showing an ash collection pit and a conveyor means for transporting the ash.

Referring now to FIG. 2, it can be seen how the surface of the refractory slopes down toward the rotatable rolls. The water unions described above have a water manifold 90 for supplying water and a manifold 96 for collecting return water. Manifold 90 is connected through a water supply tube 92 to the rotatable water union 44. A return line 94 connects to a second water manifold 96 to collect the water after it has circulated down through the rotatable roll 40 as will be explained below.

Gear 46 can be seen in this view in greater detail. Typically, the gear is formed from a high strength, heat resistant steel and is approximately a three diametral pitch spur gear.

As can be seen in FIG. 2, an ash pit 100 is located beneath the rolls of the grate of the current invention. Access doors 102 and 104 are provided for inspection, cleaning, and maintenance. Beneath the ash pit 100 is a lateral conveyor 106 driven by a suitable means 108. The conveyor removes material from the ash pit.

Figure 3:
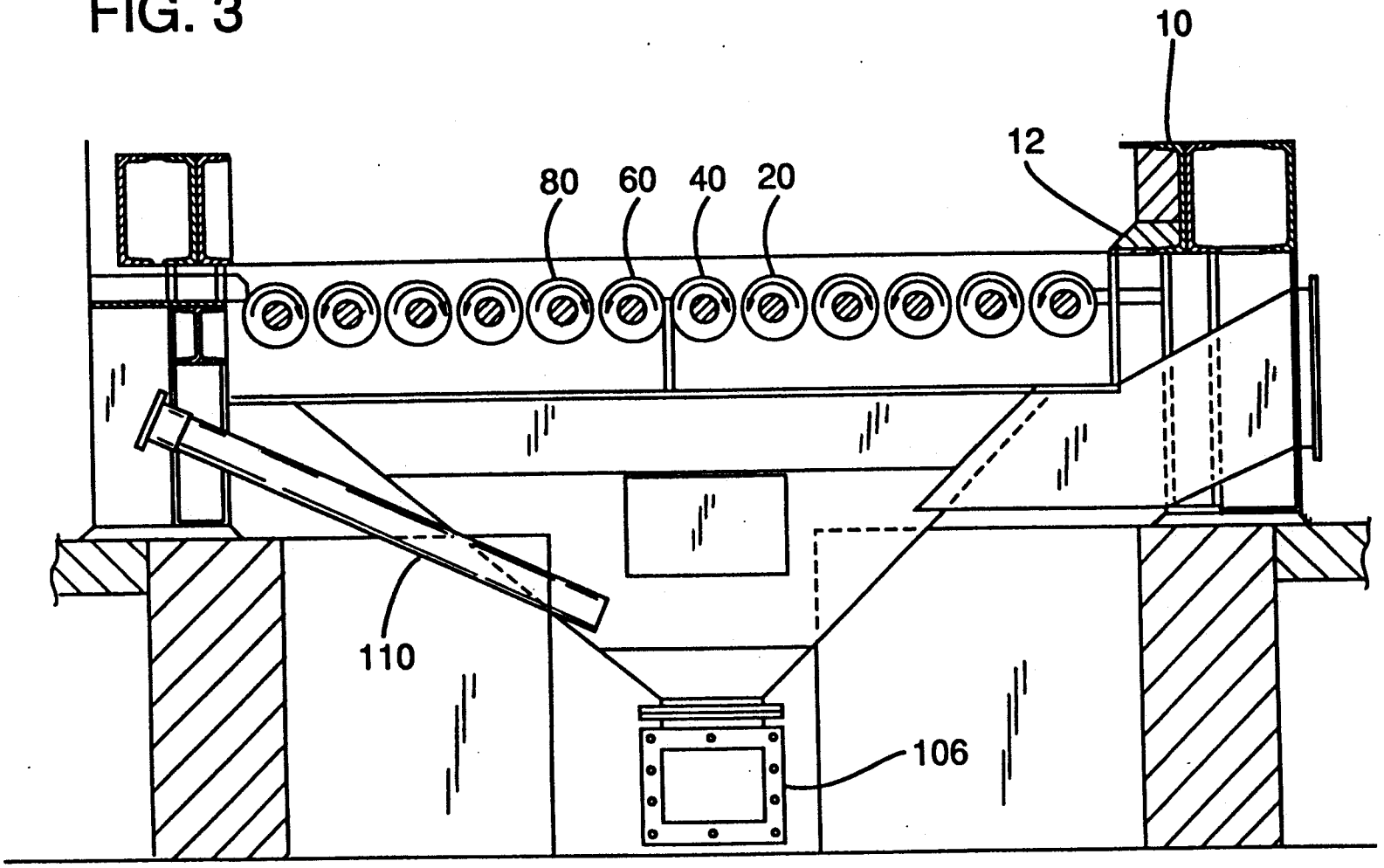
FIG. 3 is a cross-section view, along lines 3—3 of FIG. 1, of the grate portion of a fuel fired furnace of the present invention which further shows an ash collection pit.

A sight tube 110, as shown in FIG. 3, may be included for the operator to be able to see into the ash pit to insure that it is clear of material. The rolls shown in cross-section are counter-rotating due to the fact that they are geared together in pairs. Roll 20 is geared to roll 40 and roll 60 is geared to roll 80. Referring back to FIG. 1, it can be seen how the spur gears are offset so that there is no interference between the gears of adjacent pairs of rolls.

Figure 4:
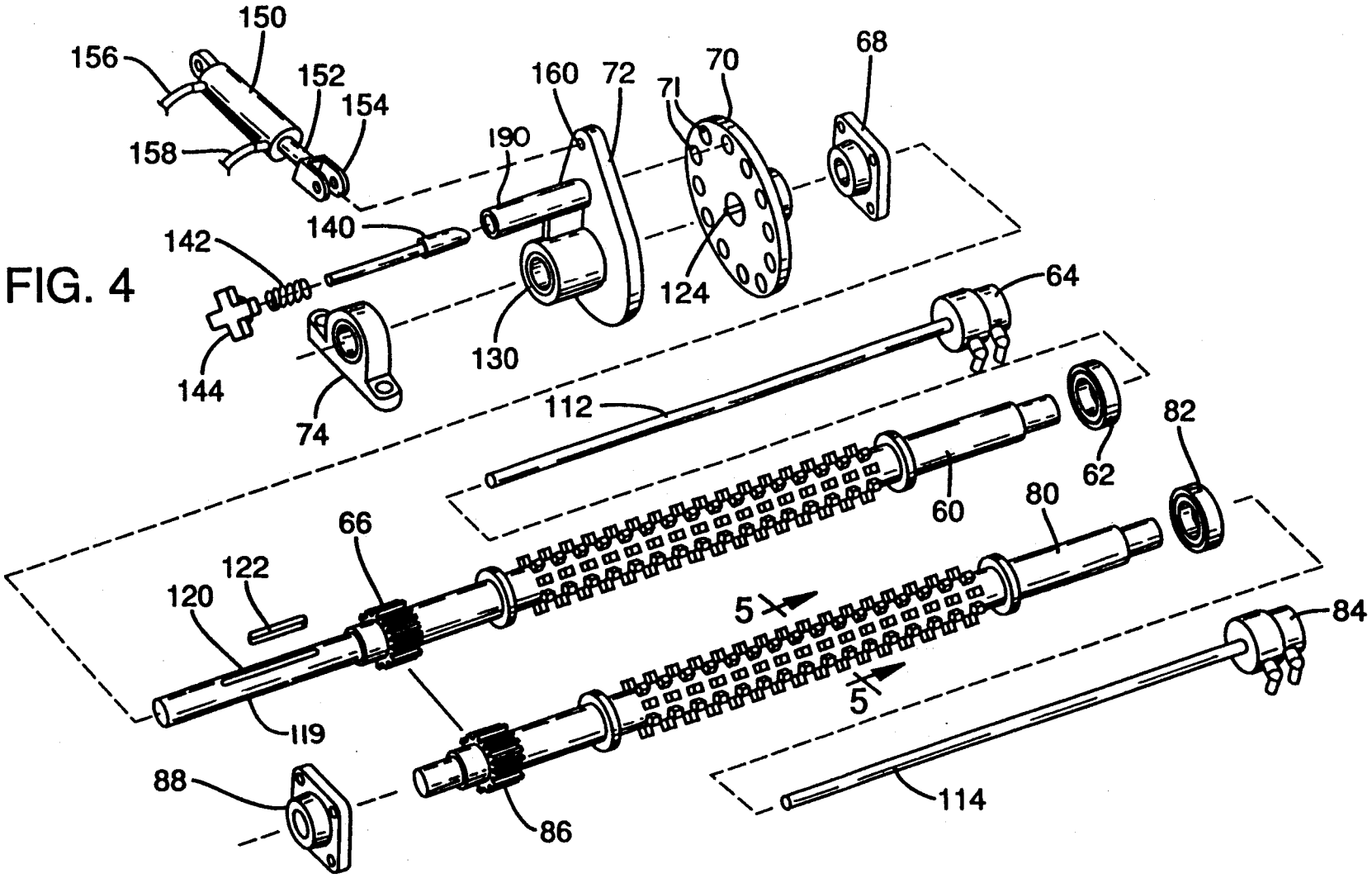
FIG. 4 is an exploded perspective view of the components of a portion of the rotary grate of the present invention.

All of the pairs of rolls are similar in respect to their length and construction, except for the length of the area which protrudes to the opening 16 of the refractory 12. It is to be understood that the following description of one pair of rolls holds equally for all the remaining pairs of rolls. Each pair of rolls has a plurality of protrusions projecting from the surface thereof as will be explained below. Referring now to FIG. 4, water union 64 is connected to a hollow tubular tube 112, which forms a water lance. The input to the water union transfers water down the inside of the tubular lance 112, whereupon it exits at the open end thereof. The water then flows between the outside of the water lance 112 and the inside of the tubular member 60 to exit through the water union 64. A similar water lance 114 is used in conjunction with the rotatable union 84 which is coupled to the roll 80. This method of cooling the rolls has been found to be efficient and prevents the rolls from overheating.

Figure 5:
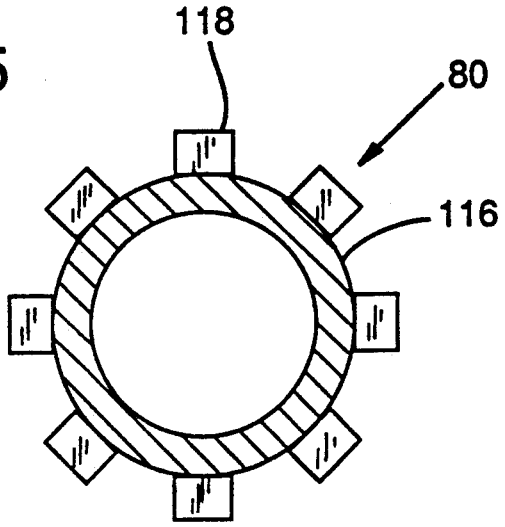
FIG. 5 is a cross-sectional view of one of the rotary tubular members, along line 5—5 of FIG. 4.

Referring now to FIG. 5, the protrusions 118 can be seen attached to a hollow tube 116 which forms the roll 80. In a preferred embodiment of the invention, the protrusions 118 are approximately 1½" wide, 1½" long, and 1" high. They are preferably made of a plow steel, which is a heat resistent high impact steel. The protrusions 118 are uniformly spaced about the periphery of the tube 116. In a preferred embodiment of the invention, the spacing is approximately every 45 degrees about the perimeter of the tube 116. Referring back to FIG. 4, in an assembled condition, spur gear 66 meshes with spur gear 86. The protrusions on roll 60 are offset from the protrusions on roll 80 such that the protrusions on roll 60 do not contact the protrusions on roll 80. The protrusions are spaced along the rolls so that a space exists between each set of protrusions. The protrusions on roll 60 fit into the spaces on roll 80, while the protrusions on roll 80 fit into the spaces of roll 60. In this manner, the protrusions pass in a non-contacting side-to-side relationship the protrusions on adjacent rolls. Each pair of rolls are constructed in a similar manner.

Drive roll 60 has a solid steel extension 119 welded to the roll 60. The solid steel extension 119 has a key seat 120 milled therein. A matching key 122 fits within the key seat and mates with a mating key seat 124 of drive disk 70. Drive disk 70 has a plurality of holes 71 located about the surface thereof extending through the drive disk. The holes in a preferred embodiment are spaced approximately every 30 degrees radially about the surface of drive disk 70. The key 122 and a set screw (not shown) rigidly attach the drive disk 70 to shaft 119 of the drive roll 60.

The ratchet plate 72 has a bearing 130 on an inside bore thereof. The inside of a bearing 130 is sized to the outside diameter of shaft 119. This allows the ratchet plate 72 to freely rotate about shaft 119. A pawl 140 fits in a tubular member 190 of the ratchet plate 72. The pawl has a nose section with a slope on one side thereof. A spring 142 keeps the pawl 140 in engagement with the drive disk 70 such that the pawl will engage a hole 71 adjacent the ratchet plate 72. A handle 144 is attached to the pawl 140 to be able to rotate the pawl 140–180 degrees, as will be explained below.

A hydraulic cylinder 150, having an output shaft 152 and a clevis 154, provides the drives means for the ratchet plate 72. Cylinder 150 is bi-directional and has two hydraulic lines 156 and 158 to actuate the cylinder. Forcing fluid into line 156 extends the rod 152 of cylinder 150 and applying fluid to hydraulic line 158 retracts the rod 152. A clevis 154 on rod 152 is attached to a suitable connection point 160 of ratchet plate 72. Bearing 74 not only supports the end of shaft 119, but also prevents the ratchet plate 72 from coming out of face-to-face engagement with drive disk 70. In a preferred embodiment of the invention, a stroke of seven inches for cylinder 150 rotates the ratchet plate approximately 37 degrees. This ensures that the pawl 140 will engage one of the holes 71 in drive disk 70.

The pressure of the hydraulic circuit which feeds lines 156 and 158 is limited so that if an overload condition is encountered, the cylinder will stall before any mechanical damage occurs in any of the remaining components.

Figure 6:
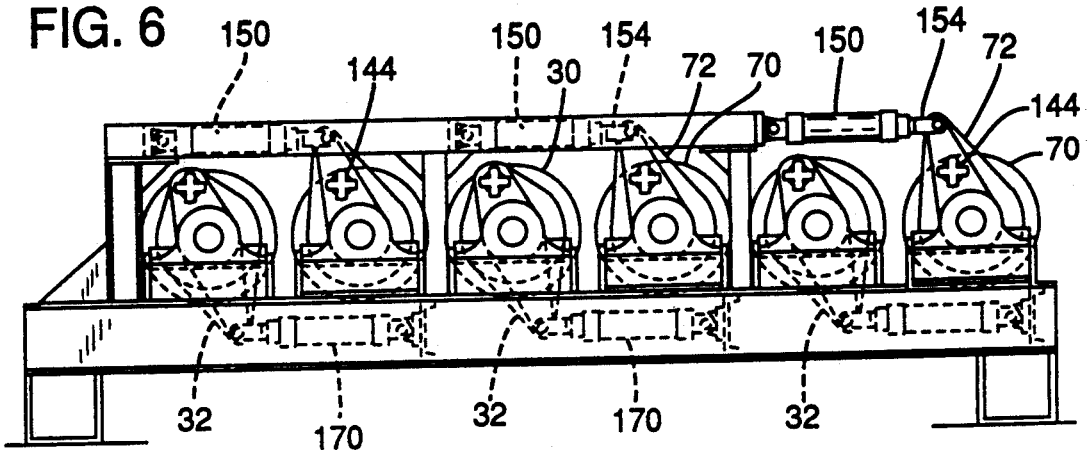
FIG. 6 is a side view of the grate portion of a solid fuel fired furnace.
Figure 7:
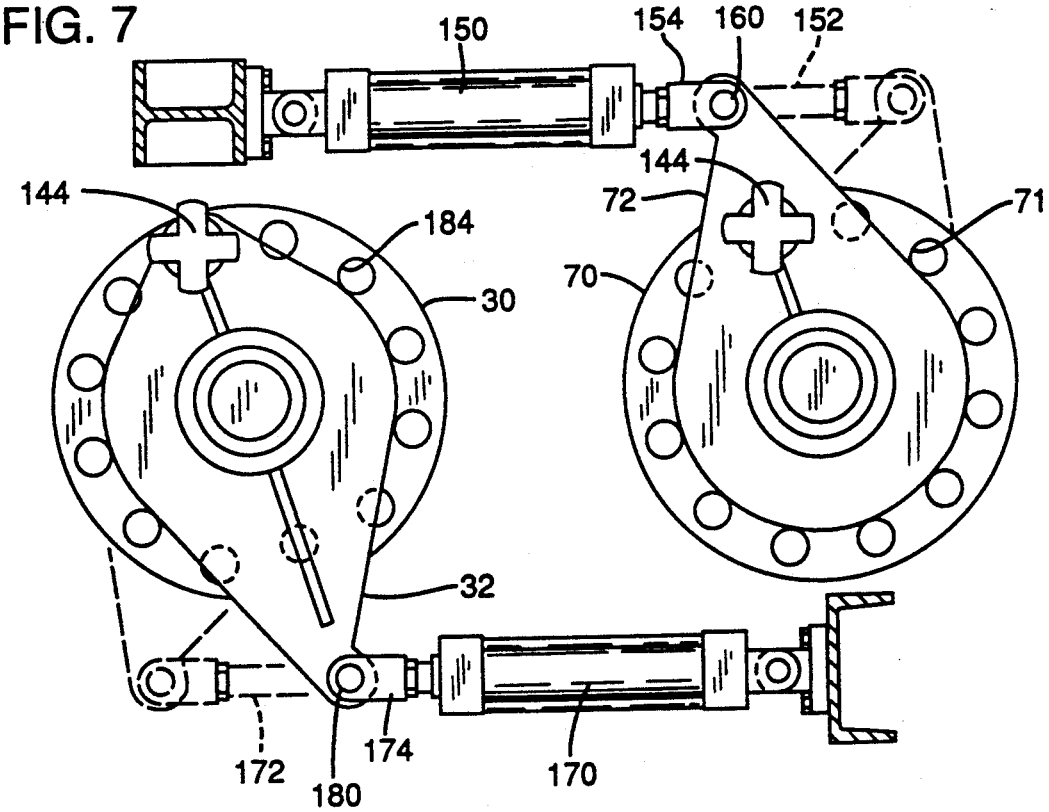
FIG. 7 is a side view of a pair of rotary actuators used to rotate the tubular members of the grate of the present invention.

FIG. 6 is a side view of a rotary grate utilizing six pair of tubular rolls. Each actuator device powers a pair of rolls. In order to package all of the linear actuators into a compact area, half of the actuators are attached to the top of framework 10 and half of the actuators are attached to the bottom of framework 10. See FIG. 7. All function in a similar manner, except that the ratchet plate 32 is of a slightly different design than ratchet plate 72 to accommodate the packaging of the various components. A cylinder 170, having a output rod 172 and a clevis 174, attaches to attachment point 180 of ratchet plate 32. Drive disk 30, as shown in FIG. 7, has a plurality of holes 184 equally spaced about the surface thereof similar to the holes 71 in drive disk 70.

Figure 8:
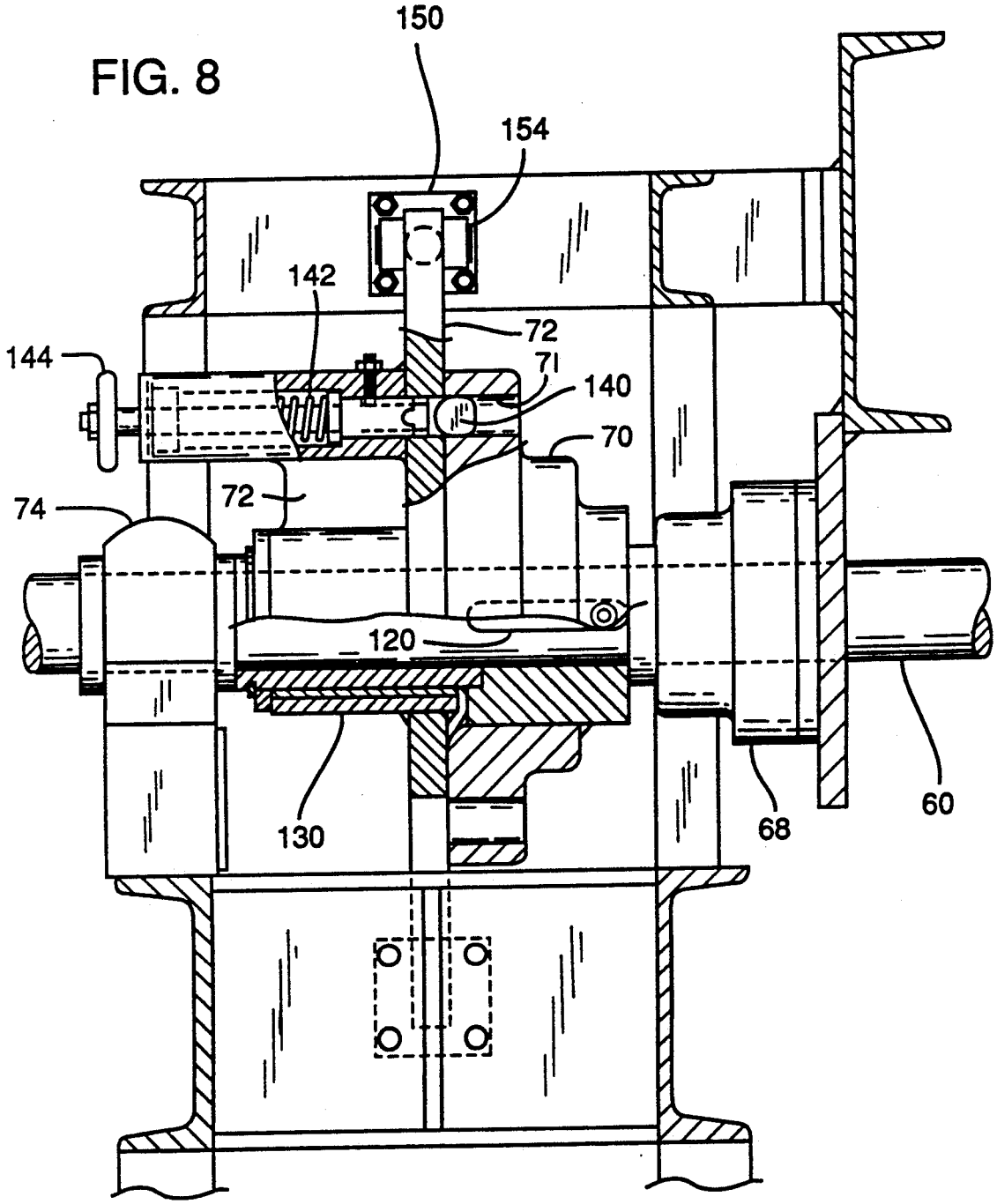
FIG. 8 is a partially, broken away side view of one of the actuators which rotates a pair of the rolls of the grate of the present invention.

To better understand the drive mechanism for the rolls of the present invention, we refer now to FIG. 8. Here the various components can be seen in greater detail. In FIG. 8, the pawl 140 has engaged one of the holes 71 in drive disk 70. As cylinder 150 is extended, the ratchet plate is moved radially, thus rotating drive disk 70. As a hydraulic cylinder 150 is retracted, the pawl is forced back against the spring 142 (shown in FIG. 9) out of engagement with hole 71 to engage the next hole.

Figure 9:
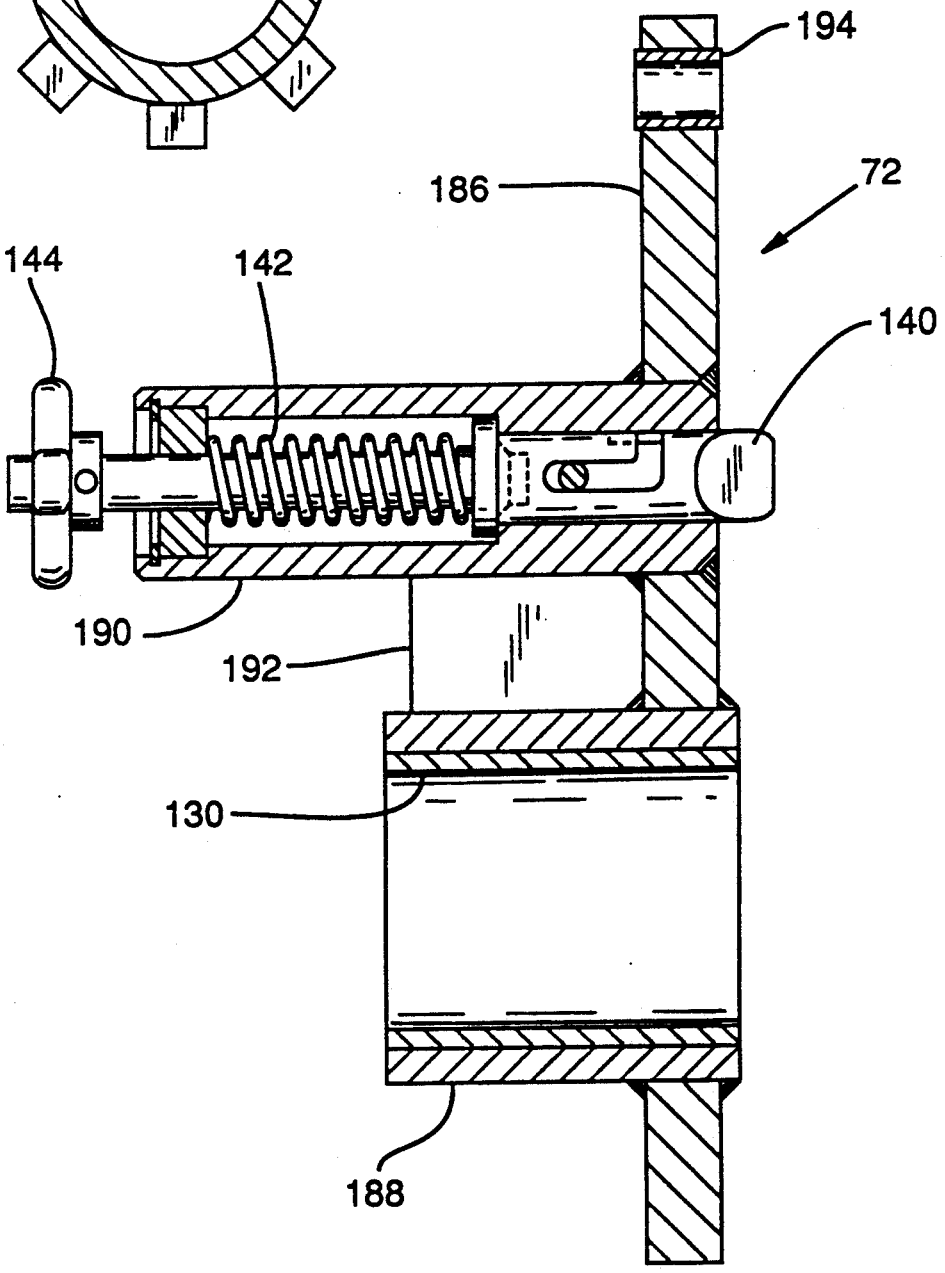
FIG. 9 is a sectional view of a ratchet plate assembly of the present invention.

FIG. 9 shows a slot arrangement in pawl 140 which prevents the pawl from rotating during normal operation, but allows the pawl to be pulled outward with handle 144. This compresses spring 142, until the slot in the pawl 144 is in a position to allow rotation of the pawl 140 180 degrees, thus reversing its action. Referring back to FIG. 8, now when the cylinder 150 is extended, the pawl 140 is compressed against the spring 142, slipping to the next hole and as the cylinder 150 is retracted, the ratchet plate 72 and pawl 140 rotate the drive disk 70 in the opposite direction.

Referring now to FIG. 9, ratchet plate 72 can be seen in more detail. Ratchet plate 72 may be a single-piece casting. As shown in FIG. 9, ratchet plate 72 is a welded member, comprised of a plate 186 with a tubular member hub 188 welded thereto. A second tubular member 190 which houses the pawl 140 is also welded to plate 186. A reinforcement web 192 is welded between the hub 188 and the tubular member 190. As can be seen in FIG. 9, the bearing 130 fits inside the hub 188 while the attachment point 160 has a bearing 194 inserted therein.

The rolls are spaced within the refractory opening 16 (FIG. 1), such that twelve and one-half (12½) percent of the area of opening 16 is open. This allows air to be drawn up, through the rolls into the burning fuel mass to aid combustion. A layer of ash forms on the rolls to assist in insulating the rolls from the heat of the burning fuel mass. Once this layer of ash accumulates, potentially blocking the air flow, the rolls are rotated to allow the ash to fall into the pit below the rolls. The frequency of rotation of the rolls may be continuous or intermittent, depending upon the combustion characteristics of the solid fuel.

Of course, it should be understood that a wide range of changes and modifications can be made to the preferred embodiments described above. It is, therefore, intended that the foregoing descriptions be regarded illustrative rather than limiting, and that it be understood that it is the following claims, including all equivalents, which are intended to define the scope of the invention.

I claim:

1. A grate for a solid fuel fired furnace comprising:

at least one pair of solid fuel-supporting rolls, said pair comprising a drive roll and a counter-rotating driven roll mounted parallel to each other;

a plurality of spaced apart protrusions on each roll, the protrusions being spaced about the periphery of the roll; and a drive means adapted continuously to rotate the drive roll such that the protrusions on the drive roll pass by, from top to bottom, in non-contacting side-to-side relationship the protrusions on the driven roll, the protrusions being adapted to crush cinders, slag and clinkers therebetween as said protrusions pass by each other.

2. A grate for a solid fuel fired furnace as recited in claim 1, wherein each of said rolls is water cooled.

3. A grate for a solid fuel fired furnace as recited in claim 1, wherein the drive roll is geared to the driven roll.

4. A grate for a solid fuel fired furnace comprising:

at least one pair of solid fuel-supporting rolls, said pair comprising a drive roll and a driven roll mounted parallel to each other;

a plurality of spaced apart protrusions on each roll; and a drive means to rotate the drive roll such that the protrusions on the drive roll pass by, in non-contacting relationship, the protrusions on the driven roll, the drive means comprising:

a drive disk attached to the drive roll;

a plurality of holes through said drive disk;

a ratchet plate rotationally supported on the drive roll, said ratchet plate being mounted adjacent said drive disk;

a reversible pawl supported in said ratchet plate for selectively engaging said holes one at a time; and a hydraulic cylinder attached to said ratchet plate to incrementally rotate said ratchet plate.

5. A grate for a solid fuel fired furnace comprising:

at least one pair of spaced apart parallel tubular rolls, said rolls being positioned adjacent one another to support the solid fuel;

water cooling means to cool said tubular rolls;

a drive means to counter-rotate said tubular rolls continuously, whereby the surfaces thereof pass by each other from top to bottom; and a plurality of protrusions on each tubular roll, said protrusions on each roll being uniformly spaced about the periphery of the roll to be in non-intersecting relationship with the protrusions on the adjacent roll, the protrusions being adapted to crush cinders, slag and clinkers therebetween as said protrusions pass by each other.

6. A grate for a solid fuel fired furnace as recited in claim 5, wherein said water cooling means comprises a rotatable union attached to each tubular roll, a water tube within said roll attached to said union, a means to supply water to said union, and a means to drain water from said union.

7. A grate for a solid fuel fired furnace as recited in claim 5, comprising a plurality of pairs of spaced apart parallel tubular rolls, each of said pairs of rolls comprising a drive roll and a driven roll and each drive roll being geared to each driven roll.

8. A grate for a solid fuel fired furnace comprising:

a plurality of spaced apart tubular rolls, said rolls being positioned adjacent one another to support the solid-fuel;

a means to cool said tubular rolls;

a drive means to rotate said tubular rolls; and a plurality of protrusions on each tubular roll, the protrusions on each roll being spaced to be in non-intersecting relationship with the protrusions on each adjacent roll, said plurality of rolls being arranged in pairs of rolls, each of said pairs of rolls comprising a drive roll and a driven roll, and each drive roll being geared to each driven roll, said drive means comprising:

a drive disk attached to each drive roll;

a plurality of holes through said drive disk;

a ratchet plate rotationally supported on each drive roll, said ratchet plate being mounted adjacent said drive disk;

a reversible pawl supported in said ratchet plate for selectively engaging said holes one at a time; and a hydraulic cylinder attached to said ratchet plate to incrementally rotate said ratchet plate.

9. A grate for a solid fuel fired furnace comprising:

a plurality of pairs of parallel mounted hollow rolls, each of said rolls having a first end and a second end and each of said pairs of rolls comprised of a drive roll and a driven roll;

a rotatable water coupling union attached to the first end of each roll, said union having a water inlet and a water outlet;

a hollow water lance centrally located inside each roll, each of said water lances having a first end and a second end, said first end of each water lance attached to the inlet of each of said unions and said second end of each of said water lances in open communication with the inside of each hollow roll;

the water outlet of each of said unions in communication with the inside of each of said rolls;

a means to supply water under pressure to the water inlet of each of said unions;

a means to collect the water from the water outlets of each of said unions;

a first gear attached to the second end of each of said drive rolls;

a second gear attached to the second end of each of said driven rolls, said second gear of each driven roll in a pair of rolls in engagement with said first gear of each drive roll in that said pair of rolls;

a plurality of protrusions radially spaced about the periphery of each roll;

said protrusions spaced along each roll and having spaces therebetween, wherein the protrusions on each drive roll meshes with the spaces between the protrusions on each driven roll in non-contacting relationship and wherein the protrusions on each driven roll meshes with the spaces between the protrusions on each drive roll in non-contacting relationship;

a drive disk attached to the second end of each of said drive rolls;

a reversible one-way drive mechanism in engagement with each drive disk;

a means to advance the drive mechanism to incrementally rotate each drive disk to rotate each drive roller; and a means to reverse the drive mechanism should an overload condition occur.

10. An apparatus to remove ash from a solid fuel fired furnace comprising:

a framework;

a refractory overlaying said framework;

an opening in said refractory;

a plurality of rolls projecting into said opening, said plurality of rolls grouped into pairs of rolls, each pair of rolls comprised of a drive roll and a driven roll;

a means to rotationally support each of said rolls on said framework;

a means to couple each drive roll to each driven roll;

a plurality of protrusions radially spaced completely about each roll and incrementally spaced along each roll within said opening such that the protrusions on each roll pass by, in non-contacting side-to-side relationship, the protrusions on an adjacent roll; and a means to rotate each drive roll continuously, thereby counter-rotating each driven roll in a manner whereby the surfaces thereof pass by each other from top to bottom to crush cinders, slag and clinkers therebetween and to allow ash to pass between the rolls.

11. An apparatus to remove ash from a solid fuel fired furnace as recited in claim 10, wherein said means to couple each drive roll to each driven roll is comprised of a first gear attached to each drive roll in engagement with a second gear in engagement with each driven roll within a pair of rolls.

12. An apparatus to remove ash from a solid fuel fired furnace comprising:

a framework;

a refractory overlaying said framework;

an opening in said refractory;

a plurality of rolls projecting into said opening, said plurality of rolls grouped into pairs of rolls, each pair of rolls comprised of a drive roll and a driven roll;

a means to rotationally support each of said rolls on said framework;

a means to couple each drive roll to each driven roll;

a plurality of protrusions radially spaced about each roll and incrementally spaced along each roll within said opening such that the protrusions on each roll pass by, in non-contacting relationship, the protrusions on an adjacent roll; and a means to rotate each drive roll, thereby counter-rotating each driven roll to allow ash to pass between the rolls, said means to rotate each drive roll comprising:

a drive disk attached to each drive roll;

a plurality of holes through said drive disk;

a ratchet plate rotationally supported on the drive roll, said ratchet plate mounted adjacent said drive disk;

a reversible pawl supported in said ratchet plate for selectively engaging said holes one at a time; and a drive means attached to said ratchet plate to incrementally rotate said ratchet plate.

13. An apparatus to remove ash from a solid fuel fired furnace as recited in claim 12, wherein said drive means comprises a hydraulic cylinder.

* * * * *